United States Patent [19]

Perri

[11] Patent Number: 4,898,369

[45] Date of Patent: Feb. 6, 1990

[54] LANCE WITH METERED CORE FOR TREATING MOLTEN METAL

[75] Inventor: Joseph A. Perri, Coraopolis, Pa.

[73] Assignee: Insul Company, Inc., East Palestine, Ohio

[21] Appl. No.: 351,889

[22] Filed: Apr. 26, 1989

Related U.S. Application Data

[63] Continuation-in-part of Ser. No. 190,019, May 4, 1989, abandoned.

[51] Int. Cl.[4] ..... C21C 5/46

[52] U.S. Cl. ..... 266/266; 266/225; 266/270

[58] Field of Search ..... 266/225, 226, 265, 266, 266/270

[56] References Cited

U.S. PATENT DOCUMENTS

| | | | |
|---|---|---|---|
| 3,082,997 | 3/1963 | Kurzinski | 266/225 |
| 3,379,428 | 4/1968 | Dortenzo et al. | 239/132.3 |
| 3,645,520 | 2/1972 | Acre et al. | 266/225 |
| 3,898,078 | 8/1975 | Huber | 266/225 |
| 4,389,245 | 6/1983 | Blair et al. | 75/58 |
| 4,550,898 | 11/1985 | LaBate, II | 266/220 |
| 4,588,170 | 5/1986 | Towns | 266/225 |

FOREIGN PATENT DOCUMENTS

| | | | |
|---|---|---|---|
| 46313 | 3/1985 | Japan | 266/266 |

*Primary Examiner*—Robert McDowell

*Attorney, Agent, or Firm*—Harpman & Harpman

[57] ABSTRACT

Apparatus for introducing stirring and refining agents into molten metal in a vessel using a lance having a refractory body and a tube extending inwardly of a first end of the refractory body and terminating inwardly of a second end thereof. A plurality of relatively smaller tubes positioned within the refractory body and communicating with said tube and extending therefrom to the exterior of said refractory body, at least a portion of each of said smaller tubes being formed in a narrow slot-like passageway whereby gas, such as argon, introduced through the tubes and delivered to the exterior of the refractory body will bubble upwardly through the molten metal in a stirring and mixing action including an annular column around the refractory body acting to protect the same from rapid erosion.

9 Claims, 2 Drawing Sheets

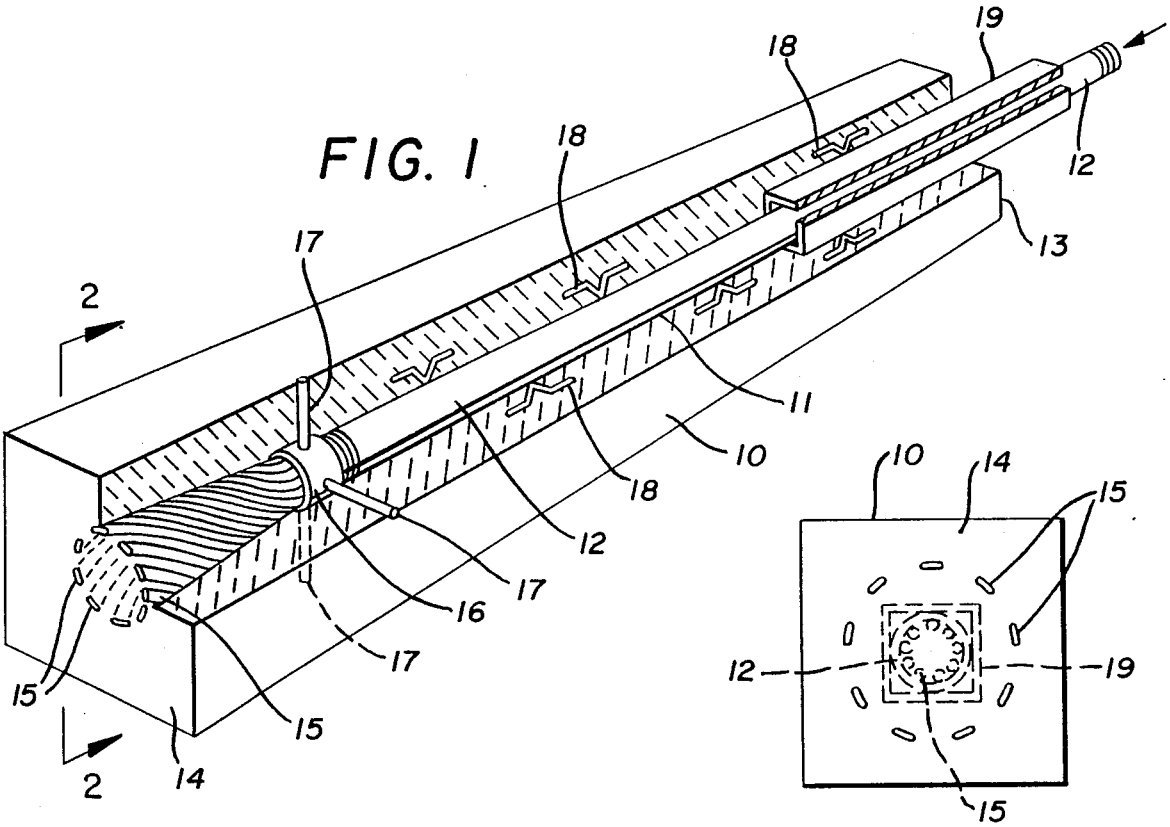
FIG. 1
FIG. 2
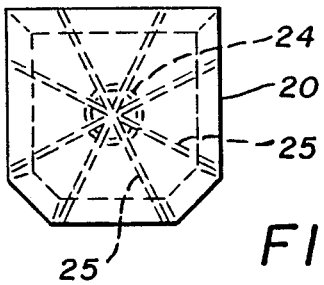
FIG. 4
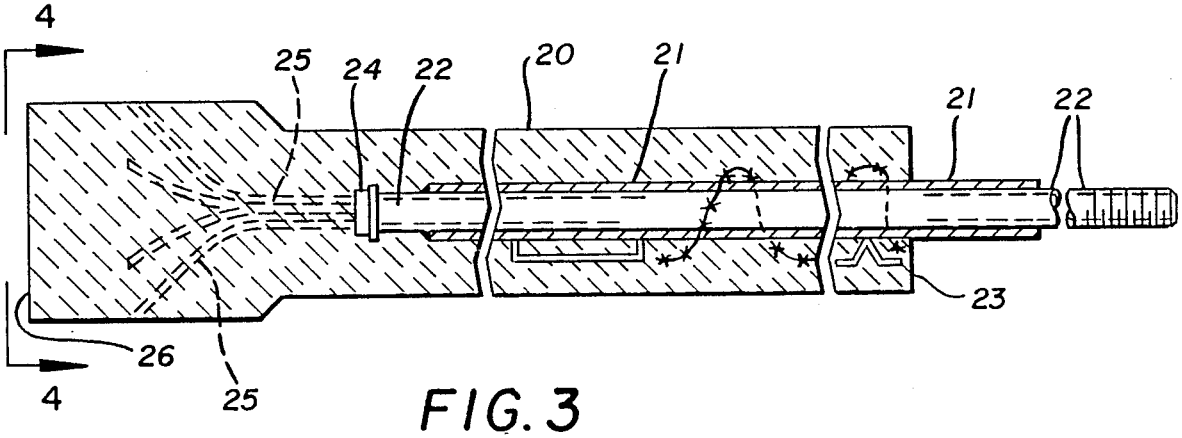
FIG. 3

LANCE WITH METERED CORE FOR TREATING MOLTEN METAL

This is a continuation-in-part application of Ser. No. 07/190,019 filed May 4, 1988 abandoned.

BACKGROUND OF THE INVENTION

1. Technical Field

This invention relates to lances such as used for introducing an inert gas into molten metal for stirring the same or for injecting a stream of oxygen into molten metal for refining the same.

2. Description of the Prior Art

Lances for introducing gases into molten metal for various purposes are disclosed in U.S. Pat. Nos. 3,379,428 and 3,082,997, which disclose immersion lances formed of straight metal tubes forming a plurality of gas conduits arranged to direct gas downwardly into the molten metal in which the lance is positioned.

U.S. Pat. Nos. 3,645,520 and 3,898,078 disclose lances in which the gas conveying conduits are formed in several patterns, the U.S. Pat. No. 3,645,520 providing an axial metal conduit around which several tubes are spirally wound and encased in an exterior housing which may be a protective refractory.

Alternate forms of the disclosure position the metal tubes in various patterns and surrounds them with a refractory body and one such form adds an exterior housing, partly metal and partly refractory.

U.S. Pat. No. 3,898,078 forms the lance of a pair of tubular members, one positioned within the other with the inner tubular member having a relatively thick end portion in which helical passageways are formed so that gas introduced into an area between the tubular members will flow through the helical passageways which communicate with the delivery end of the lance. The lower portion of this end of the lance is covered with a suitable refractory.

U.S. Pat. Nos. 4,389,245 and 4,550,898 disclose lances having straight gas conveying conduits therein and refractory housings of cylindrical cross section thereabout and U.S. Pat. No. 4,588,170 discloses a lance which is primarily an elongated refractory body having a tubular gas conduit extending longitudinally thereof and terminating inwardly of the ends thereof in a cavity opening inwardly.

The present invention relates to a substantially improved lance for treating molten metals in which the principal body of the lance is formed of a refractory material with a bore extending longitudinally through a portion of the refractory material and terminating inwardly of the delivery end of the lance where it communicates with a plurality of smaller metal tubes preferably arranged in a circular pattern in which the smaller metal tubes are spirally positioned, each of the smaller metal tubes being shaped such as partially flattened to form a metered passageway of a desired size, the distal ends of the smaller metal tubes communicate with the delivery end of the lance so that most of the gas flowing through the smaller metal tubes will be delivered into the molten metal in a spiral swirling pattern in a predetermined amount at a predetermined pressure. The bore in the principal body member of the lance is preferably a metal tube communicating with the plurality of smaller metal tubes at one of its ends and extending outwardly of the refractory body of the lance at its other end. The diameter of the bore, about 1½", and the outer diameter of the metal tube, about 1½", are less than or equal to one-fourth of the side to side dimensions, about 10", of the refractory body of the lance.

The novel construction of the bore in the relatively thick refractory body of the lance utilizing the metal tube and the plurality of smaller metal tubes extending from the same to the delivery end of the lance enables the lance to be more effectively used in introducing gas into molten metal and contributes to its substantially longer life than has heretofore been possible with the prior art lances as an additional pattern of bubbling gasses in the molten metal envelopes the refractory material of the body of the lance and the relatively thick refractory body of the lance protects the metal tubes from rapid failure.

SUMMARY OF THE INVENTION

A lance for treating molten metal by introducing inert gas for stirring or for injecting oxygen or another gas into molten metal or slag has an elongated thick refractory body with a relatively small bore extending partially axially thereof defined by a metal tube communicating with a plurality of smaller metal tubes extending axially to the delivery end of the lance in a circular pattern and arranged in a spiral configuration therein. Secondary smaller metal tubes communicate with the first mentioned metal tube and extend outwardly to the sides of the elongated refractory body at desired locations to provide additional gas bubbles along the sides of the lance when in vertical position to protect the refractory body of the lance from erosion by the slag which is moved away from the refractory body of the lance by the gas bubbles in the molten metal.

DESCRIPTION OF THE DRAWINGS

FIG. 1 is an elongated perspective view with parts in cross section illustrating the lance;

FIG. 2 is a view on line 2—2 of FIG. 1 of the delivery end of the lance;

FIG. 3 is a longitudinal section of a modified form of the lance;

FIG. 4 is an end elevation on line 4—4 of FIG. 3;

DESCRIPTION OF THE PREFERRED EMBODIMENT

Figure 5:
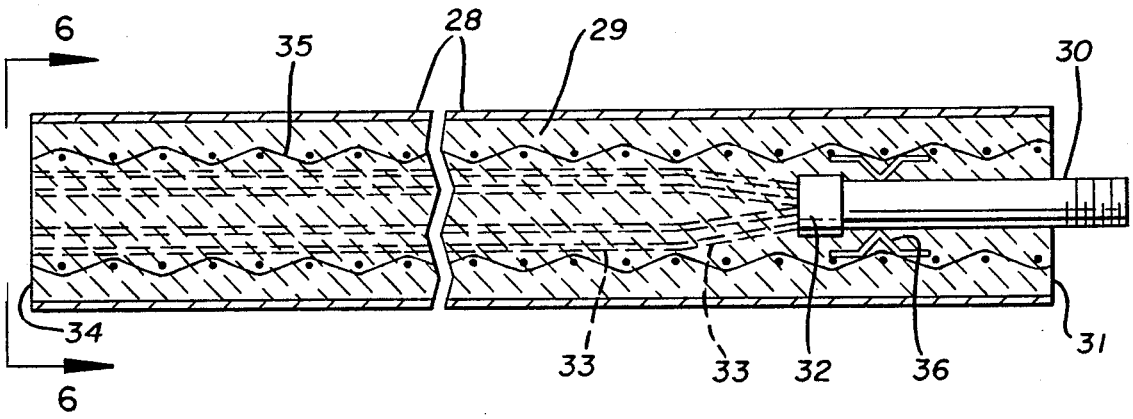
FIG. 5 is a longitudinal section of a still further modification of the lance.

In the form of the invention illustrated and described herein, the lance for treating molten comprises a solid or porous unusually thick walled preferably cross sectionally square elongated refractory body 10 having a relatively smaller bore 11 extending axially partially therethrough and defined by a metal tube 12, one end of which extends outwardly of the normal first end portion 13 of the lance body 10. The opposite end of the elongated refractory body 10 forms the delivery second end portion 14 and a plurality of small metal tubes 15 communicate with the delivery end 14 of the lance and extend inwardly in a circular pattern with the small metal tubes 15 arranged in a spiral configuration, their inner ends communicating with a fitting 16 which in turn communicates with the metal tube 12. The metal tube 12 and the plurality of small metal tubes 15 accordingly form the gas delivery bore of the elongated refractory body 10 of the lance. The refractory body 10 has a central portion.

The plurality of smaller metal or ceramic tubes are surrounded by refractory at least as thick as the diameter of the metal or ceramic tube and the diameter of the plurality of smaller circumferentially positioned metal or ceramic tubes.

An example of a lance formed in accordance with this invention has a body 10 of about 9 feet long, about 10 inches wide (thick) and is of cross sectionally square shape. The bore in the lance is about 1½ in diameter throughout most of its length and a section of cross sectionally square metal tubing 19 about 2" wide is positioned in the upper first end of the refractory lance body 10 and extends outwardly thereof.

It will be seen that the 10 inch thickness of the refractory body 10 of the lance is at least 6 times the 1½ inch diameter of the metal tube 12 ($6\times1\frac{1}{2}=9$) so that the thickness of the coating of the refractory over and surrounding the metal tube is at least 4½ inches thick and the diameter of the metal tube 12 is less than one-fourth of the known width of the refractory body 10. The smaller metal tubes 15 are about ¼" in diameter and are flattened throughout most of their length. Each of the plurality of small metal tubes 15 is shaped such as partially flattened to form a predetermined sized metered opening of a generally elongated oval shape as best seen in FIG. 2 of the drawings. The opening may be rectangular.

By referring again to FIG. 1 of the drawings, it will be seen that the fitting 16 is provided with several circumferentially spaced openings which communicate with several secondary small metal tubes 17 which extend to the outer side surfaces of the elongated principal refractory body member 10 of the lance. The tubes 15 and 17 may be ceramic.

In FIG. 1 of the drawings, several modified V-shaped reinforcing members 18 are illustrated attached at the apex of their V-shape to the metal tube 12 so as to extend outwardly into and reinforce and join the relatively thick refractory material of the body 10 of the lance to the metal tube to hold the same in fixed position. The section of a cross sectionally square metal tubing 19 is positioned on and attached to the metal tube 12 and is positioned so as to extend inwardly of the normal upper end 13 of the lance body and outwardly thereof as illustrated. The construction facilitates the attachment of means not shown by which the lance is suspended and positioned over a ladle or the like into which the lance is to be position and additionally the square metal tube 19 reinforces the upper end of the lance and also carries one or more of the reinforcing member 18 heretofore referred to.

It will be seen that in the preferred form of the invention as illustrated in FIGS. 1 and 2 of the drawings and hereinbefore described the lance when positioned vertically and lowered into a vessel in which molten metal is present and argon gas or another gas or oxygen is supplied to the outer end of the metal tube 12 as will be understood by those skilled in the art, the gas, oxygen or the like will flow downwardly in the metal tube 12 defining the bore 11 of the lance and into the fitting 16 which may be located at any position between the normal upper end 13 and the delivery end 14 of the lance and from there most of it will flow through the plurality of small metal tubes 15 and the volume of the gas delivered therefrom into the molten metal will be determined by the configuration of the metered shaped portions of the metal tubes 15. Additionally, some of the gas will flow out of the fitting 16 into the secondary tubes 17 which communicate with the surface of the sides of the refractory body 10 of the lance whereupon an additional supply of bubbles will be provided which will rise upwardly along the normally vertically positioned lance and move the molten metal in an upwardly flowing annular column of molten metal around the body of the lance 10 and thus impart a cooling effect to the side walls of the lance as well as the column of upwardly moving molten metal moving any slag thereon away from contact with the lance body 10.

Additionally, the spiral configuration of the plurality of smaller metal tubes 15 arranged in a circular pattern as disclosed will cause the gas issuing therefrom to flow upwardly and around the sides of the normally vertically positioned lance and create a substantially annular column of stirring bubbling molten metal around the sides of the lance which will also tend to move any slag thereon away from the integral lance body 10.

Those skilled in the art will observe that modifications of the structure hereinbefore disclosed are possible, and one such modification may be seen in FIGS. 3 and 4 of the drawings.

By referring to FIG. 3 of the drawings, a vertical section through an elongated lance may be seen wherein a refractory body 20 of preferably substantially square cross section is illustrated having a core therein defined by a metal tube 21 in which a secondary metal tube 22 is positioned so that one end thereof extends outwardly of the normally upper end 23 of the lance and the other end of which extends outwardly of the inner end of the metal tube 21. A fitting 24 is affixed to the inner end of the secondary metal tube 22 and a plurality of smaller metal tubes 25 communicate with the fitting 24 and extend axially of the lance body 20 a short distance and then flare outwardly radially to communicate with the outer surface of the lance at locations spaced inwardly of the delivery end 26 of the lance.

In FIG. 3 of the drawings, a reinforcing member 27 is shown attached to the metal tube 21 and some barbed wire reinforcing metal strands 28 are illustrated positioned around the metal tube 21 in spaced relation thereto so as to reinforce the refractory body 20 of the lance.

It will occur to those skilled in the art that in the modification illustrated in FIGS. 3 and 4 of the drawings and hereinbefore described the bubble pattern of argon gas and/or oxygen or other gas introduced into molten metal through the lance will not only create desirable stirring and mixing of the metal, but will provide a protective annular curtain of bubbles around the normally vertically positioned lance due to the delivery of the gas to the sides of the lance slightly inwardly of its delivery end 26.

Figure 6:
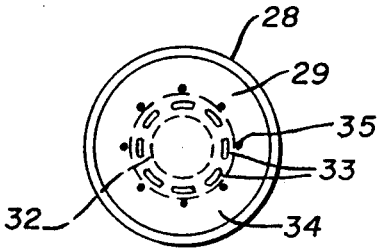
FIG. 6 is an end elevation thereof on line 6—6 of FIG. 5.

A still further modification of the invention may be seen in FIGS. 5 and 6 of the drawings and by referring to FIG. 6 it will be seen that the modified lance disclosed therein comprises an elongated metal tube 28 having a refractory core 29 therein. A second tube 30 is positioned in the normally upper end 31 of the refractory core 29 of the lance and extends outwardly therefrom a short distance so that it can be placed in communication with a source of argon gas, oxygen, or other desirable gas and the inner end of the tube 30 is provided with a fitting 32 which is apertured to receive and establish communication with a plurality of small metering tubes 33 which are arranged preferably in an annular pattern and extend to the delivery end 34 of the lance. An elongated tubular reinforcing mesh 35 is positioned longitudinally of the lance and the refractory core 29 is formed in the metal tube 28 around the secondary metal tube 30 and holds the plurality of small metering tubes 33 in desirable position. Substantially V-shaped reinforcing members 36 are attached to the secondary metal tube 30 and insure the spaced positioning of the tubular reinforcing mesh 35 with respect thereto.

In FIG. 6 of the drawings, it will be observed that the ends of the small metered tubes 33 are arranged in a circle and it will be seen that argon gas or oxygen or the like introduced into the secondary metal tube 30 will flow longitudinally of the lance through the metering tubes 33 and be directed from the delivery end 34 of the lance in a circular pattern which will not only provide advantageous stirring and mixing actions in the molten metal in which the lance is immersed, but will insure the delivery of a continuous annular column of bubbles upwardly and around the normally vertically positioned lance which will increase the life of the lance by protecting the metal tube 28 from premature failure and/or erosion as occurs when molten metal and/or slag are in contact therewith.

It will occur to those skilled in the art that a refining agent in addition to oxygen and/or argon gas may be introduced through the lance as is sometimes necessary in improving the chemistry of molten metal.

The provision of the novelly shaped small metered tubes for delivering gas or the like into the molten metal enables a desired quantity of the gas at a desired injection rate to be controlled as each of the small metal tubes is formed in a flattened oval shape of a desirable configuration so that a lance incorporating the same can match any desired discharge of gas into the molten metal. For example, gas supplied at 300 pounds per square inch can be desirably discharged at the rate of 200 feet per minute by preshaping the flattened oval shapes of the small metal tubes to a predetermined shape such as illustrated and described herein, for example wherein the diameter of each small metal tube is a quarter inch o.d. is flattened to an increased width of 5/16th of an inch to form a flattened discharge orifice of 0.026/100ths of an inch.

The sizes of the several parts of the lances of the modifications seen in FIGS. 1–3 and in FIGS. 5–6 of the drawings are substantially the same as the sizes of the similar parts in the lance seen in FIG. 1 and 2 of the drawings.

It will thus occur to those skilled in the art that lances formed in accordance with this invention may be easily custom formed for use in converters as well as ladles in which the molten metal being treated is positioned.

Those skilled in the art will observe that the structure of the lance hereinbefore described can be shortened and used effectively as a bottom stirring gas blowing tuyere.

Although but three embodiments of the present invention have been illustrated and described, it will be apparent to those skilled in the art that various changes and modifications may be made therein without departing from the spirit of the invention and having thus described my invention what I claim is:

1. A lance for use in treating a bath of molten metal comprising an elongated refractory body having a central portion and first and second integral end portions all of a known width extending axially therefrom, a metal tube of a diameter less than or equal to one-fourth said known width of said elongated refractory body positioned axially in said central portion and said first end portion of said elongated refractory body so as to extend out of said first end portion and terminate inwardly of said second end portion, a plurality of smaller metal tubes arranged in a circular pattern communicating with said metal tube and positioned axially in said second end portion of said elongated refractory body and extending therefrom to the exterior end of said second end portion which defines the delivery end of said lance, means engaging said first mentioned metal tube and extending outwardly of said first end portion of said refractory body by which said lance may be supported, said plurality of smaller metal tubes being surrounded by said refractory body forming a coating thereover of a thickness greater than the diameter of said smaller metal tubes arranged in said circular pattern, a least a portion of each of said smaller metal tubes being formed to define a narrow slot whereby a controlled volume and flow of gas at a known pressure can be discharged thereby.

2. The lance for use in treating a bath of molten metal set forth in claim 1 and wherein each of said plurality of smaller metal tubes is arranged in circumferentially spaced relation to one another in a spiral pattern.

3. The lance for use in treating a bath of molten metal set forth in claim 1 and wherein some of said plurality of smaller metal tubes in said second end portion of said refractory body communicating with said metal tube extend to the exterior of said second end portion of said refractory body.

4. The lance for use in treating a bath of molten metal set forth in claim 1 and wherein some of said plurality of smaller metal tubes in said second end portion of said refractory body communicating with said metal tube extend to the outer sides of said refractory body in said second end portion thereof whereby gas flowing therethrough will bubble upwardly alongside said refractory body of said lance.

5. The lance for use in treating a bath of molten metal set forth in claim 1 wherein some of said plurality of smaller metal tubes in said second end portion of said refractory body communicating with said metal tube extend to the exterior end of said second end portion of said refractory body and the remainder of said plurality of smaller metal tubes extend to the sides of said refractory body in the second end portion thereof and wherein each of said plurality of smaller metal tubes extending to said exterior end of said second end portion of said refractory body is partially flattened to control the volume and flow of gas directed therethrough.

6. The lance for use in treating a bath of molten metal set forth in claim 1 wherein said plurality of smaller metal tubes are arranged in side by side relation in a spiral pattern which extends to the exterior of the delivery end of said elongated refractory body.

7. A lance for use in treating a bath of molten metal comprising an elongated refractory body having upper end lower ends, a metal tube of a known diameter positioned axially in said elongated refractory body so as to extend out of said upper end thereof and terminate inwardly of said lower end thereof, the width of said refractory body being at least four times the known diameter of said metal tube, a plurality of smaller metal tubes in said refractory body communicating with said metal tube and positioned circumferentially of one another in a group of a known diameter and generally axially of said elongated refractory body so that and said plurality of smaller metal tubes are surrounded by refractory thicker than said known diameter of said plurality of smaller circumferentially positioned metal tubes, some of said plurality of smaller metal tubes extending to the lower end of said refractory body so as to communicate with the exterior thereof and the remaining smaller metal tubes extending from said group to the sides of said refractory body and means engaging said metal tube and extending outwardly of said upper end of said refractory body by which said lance may be supported.

8. A lance for use in treating a bath of molten metal comprising an elongated refractory body having upper end lower ends, a ceramic tube of a known diameter positioned axially in said elongated refractory body so as to extend out of said upper end thereof and terminate inwardly of said lower end thereof, the width of said refractory body being at least four times the known diameter of said ceramic tube, a plurality of smaller ceramic tubes in said refractory body communicating with said ceramic tube and positioned circumferentially of one another and generally axially of said elongated refractory body so that said plurality of smaller ceramic tubes are surrounded by said refractory body forming a coating thereover of a thickness greater than the known diameter of the plurality of smaller circumferentially positioned ceramic tubes, some of said plurality of smaller ceramic tubes extending to the lower end of said refractory body so as to communicate with the exterior thereof and the remaining smaller ceramic tubes extending to the sides of said refractory body and means engaging said refractory body and extending outwardly of said upper end of said refractory body by which said lance may be supported.

9. The lance for use in treating a bath of molten metal set forth in claim 8 and wherein each of said plurality of smaller ceramic tubes is arranged in circumferentially spaced relation to one another in a spiral pattern.

* * * * *